US012796804B2

(12) United States Patent
Owoc

(10) Patent No.: US 12,796,804 B2
(45) Date of Patent: Nov. 17, 2026

(54) RAPID DEPLOY, FOOT-ACTIVATED-DETACH /AUTO-ATTACH, COMBINATION MAGNETIC CONTACT DUSTPAN AND BROOM, SWEEPING METHOD

(71) Applicant: Gregory John Owoc, Greenville, SC (US)

(72) Inventor: Gregory John Owoc, Greenville, SC (US)

( * ) Notice: Subject to any disclaimer, the term of this patent is extended or adjusted under 35 U.S.C. 154(b) by 713 days.

(21) Appl. No.: 18/199,047

(22) Filed: May 18, 2023

(65) Prior Publication Data

US 2024/0381993 A1 Nov. 21, 2024

(51) Int. Cl.
*A46B 15/00* (2006.01)
*A47L 13/52* (2006.01)

(52) U.S. Cl.
CPC ..... *A46B 15/0095* (2013.01); *A47L 13/52* (2013.01); *A46B 2200/302* (2013.01)

(58) Field of Classification Search
CPC ..... A46B 15/0055; A46B 15/0095; A46B 15/0097; A46B 17/00; A46B 17/08; A46B 2200/302; A46B 2200/3026; A46B 2200/3033; A47L 13/52
USPC ..... 15/159.1, 257.1–257.8
See application file for complete search history.

(56) References Cited

U.S. PATENT DOCUMENTS

| | | | |
|---|---|---|---|
| 224,334 | A | 2/1880 | Heath |
| 226,877 | A | 4/1880 | Pierce |
| 422,240 | A | 2/1890 | Marshall |
| 468,433 | A | 2/1892 | Bishop |
| 1,082,128 | A | 12/1913 | Low |
| 1,375,017 | A | 4/1921 | Russell |
| 1,984,491 | A | 12/1934 | Ozdowbinski |
| 2,553,727 | A | 5/1951 | Schlutz |
| 5,826,297 | A | 10/1998 | Footer et al. |

(Continued)

FOREIGN PATENT DOCUMENTS

| | | |
|---|---|---|
| EP | 0 913 118 A1 | 10/1998 |

*Primary Examiner* — Brian D Keller
*Assistant Examiner* — Aaron R McConnell

(57) ABSTRACT

Problem: The difficulty of bending down or squatting (as well as only being able to use one hand to sweep) can lead to back, shoulder and arm/hand injury risk, particularly for the elderly, when sweeping a floor, and can be unhygienic. Moreover, the on/off snap-fitting process (to broom handle) can cause hand or finger injury in present dustpan-broom combination products available.

Solution: Disclosed is a novel, rapidly attachable/detachable, minimalist and lightweight combination dustpan and broom that are mutually, aesthetically form-fitted and magnetically joined. Preferably foot-activated to drop to the floor and the dustpan is automatically re-attachable (with debris inside) by simply placing the broom over the magnetic mating contact areas that may be located nearly anywhere on the dustpan and broom. Various modifications and applications (for push-brooms also) are disclosed, such as having at least one magnetically pivoting hinge (and detachable) contact area whereby a user can simply lever-activate the dustpan handle to release and discard the secured debris contents over a trash receptacle when finished, without ever having to separate the dustpan and broom.

15 Claims, 10 Drawing Sheets

(56) References Cited

U.S. PATENT DOCUMENTS

| | | | | |
|---|---|---|---|---|
| 5,893,145 | A | 4/1999 | Thayer et al. | |
| 2018/0008115 | A1* | 1/2018 | Trevino | A47L 13/52 |

* cited by examiner

P1
2
4
5
6
8
10
12
14
15
16
17
19
115
145
146
147

P2

Fig. 2B
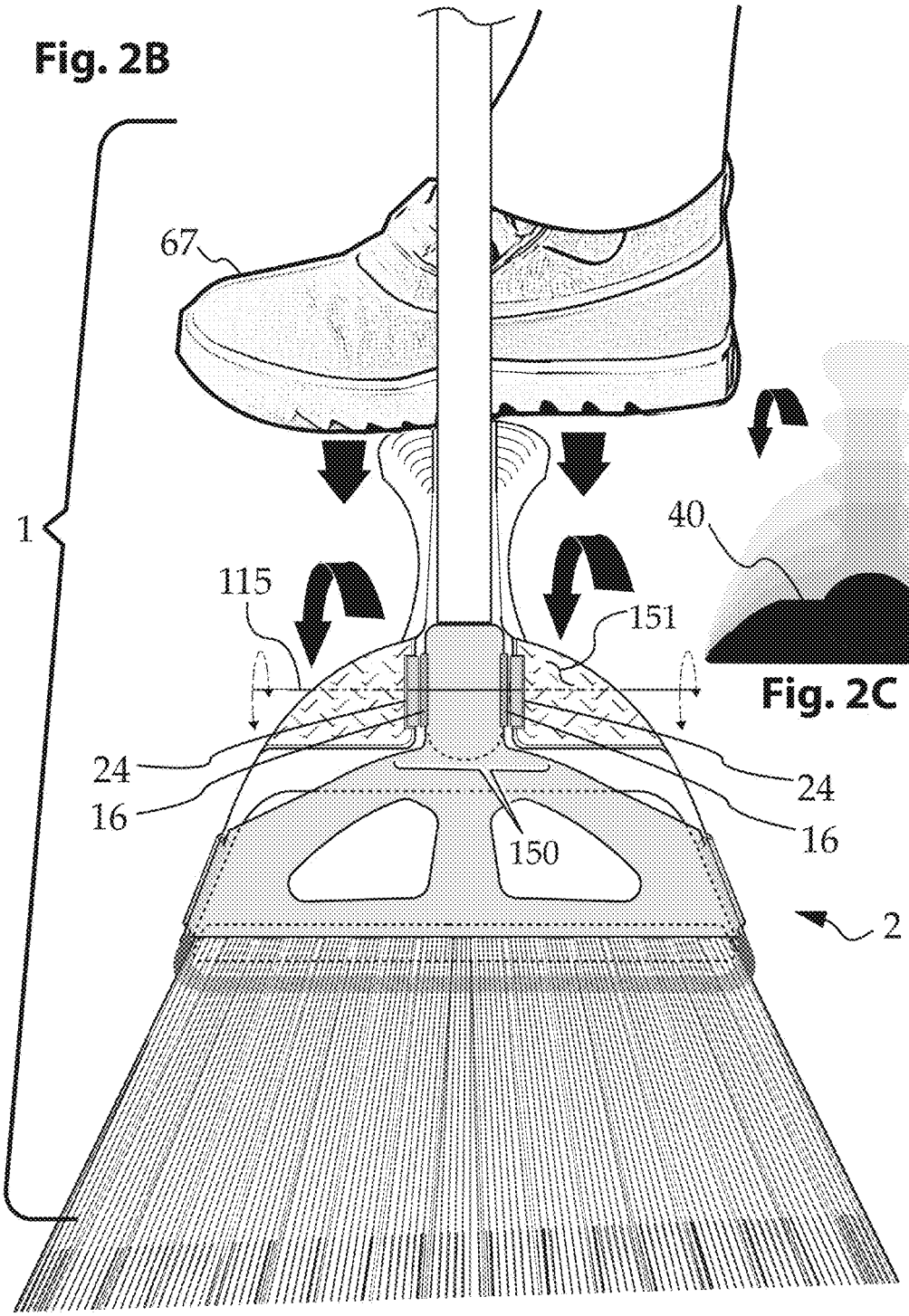
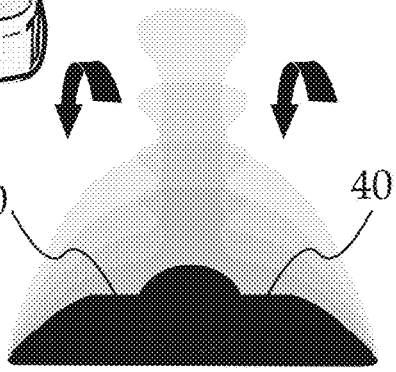
Fig. 2C 150
115
24
1
58
OPEN
CLOSE
67
40
62
28
48
62
60

60
62
64

60
62
64

P4

P7

P8

P10

RAPID DEPLOY, FOOT-ACTIVATED-DETACH /AUTO-ATTACH, COMBINATION MAGNETIC CONTACT DUSTPAN AND BROOM, SWEEPING METHOD

BACKGROUND

Field of the Invention

The invention relates to the field of floor cleaning apparatus, particularly traditional brooms, both standard upright and push type, that are typically used in conjunction with a dustpan.

Background of the Invention

Various apparatuses of a combination broom and dustpan are known in the art. Ordinarily, a broom and dustpan are kept near one another, though separated, or, because of the propensity to misplace a dustpan, many dustpans today are made snap-fittable to the handle of a broom to alleviate that inconvenience.

Moreover, the well-known present routine process of sweeping a floor or area involves taking the broom, sweeping and gathering the debris into a pile (usually a quite small quantity mixture of dust, lint, dog hair and dirt, for eg.) then locating the dustpan, then doing the "pick up" or loading the debris onto dustpan phase—by grasping its handle (sometimes being dirty itself) with one hand and then stooping or squatting, or bending over, holding the dustpan firmly to the floor, while the other hand holds the handle of the broom and then (often laboriously) sweeping the debris into the pan, then taking the pan to the waste pail and emptying it. Then, the user snaps the pan back onto to the broom handle for storage.

Besides having to place one's hands on a potentially grimy, unhygienic standard dustpan handle, as well as the necessity of having one's hands near or touching the floor being unsanitary, the major problem is that this work activity, as such, is arduous, requires squatting and can foster injury to the back, shoulders, arms, hands (and fingers) or legs, since it usually puts the human body into contorted or difficult muscular stress and physical imbalance, particularly for elderly or physically challenged people.

Moreover, beyond the difficulty and risks of the sweeping process and debris pick-up itself, the dustpans that snap-attach to the handle of a broom are often difficult for the average person, let alone the elderly, to pull off and re-attach since they necessarily clamp tightly together and require significant hand, wrist and finger strength to attach and detach.

Thus, even the convenience and advantage of having the dustpan and broom clampingly-combined, of which purpose is to make locating the dustpan easier for clean-up, this is still a comprehensively unsatisfactory solution than what the present invention achieves and solves as easy and harmonious use of a similar, but significantly re-invented, unique new combo.

No solution to date has adequately met the unsolved problems and frustration and injury risks above, particularly fingers and wrist, of not only the clamping/unclamping injury risks, as the clamped combo structures still are providing no actual functionality solution to the root problems and even health risks associated with the present method, structure and function as to how the dustpan and broom are used at present.

While there is really no specifically and significantly relevant prior art to the disclosed invention, there is some art beginning as far back as Feb. 9, 1892, G, H, Bishop, U.S. Pat. No. 468,433 that discloses a dustpan and broom combination that temporarily joins these two said work pieces by a hinge and clasp pin during storage, whereby later they are manually separated to use.

Another representative patent with this connecting structural feature is disclosed in U.S. Pat. No. 1,984,491, Apr. 10, 1934, by A. Ozdobinski, wherein a broom's handle has a clamping, attachable-detachable dustpan hollow handle portion attached thereto. The dustpan end portion handle flexes slightly, expanding in width and snap-fits onto the broom handle area at its lower broom bristle support area. Another quite similar structure to the '491 patent is disclosed in U.S. Pat. No. 2,553,727, Apr. 16, 1947, by G. M. Shultz and still another, more recently, in U.S. Pat. No. 5,839,145, Nov. 24, 1998, by Robert Petner, which alternately uses a clasping slide-collar to secure the broom handle to the dustpan handle's end portion.

Still another similar structure is disclosed in France Patent FR 2,802,794-A1, Dec. 23, 1999, by Brison Marc Pierre, wherein the internal dustpan handle portion includes molded snap-fit "nubs" that grip the said broom handle when attached by a user. Though useful for preventing misplacing of the dustpan, this patent nor none of these above and many like combination dustpan/broom "connecting/attachment" apparatuses or systems devised address or solve the former and following discussed health risks and problems associated with broom and dustpan use, however. This is all in addition to the unmatched speed over previous broom and dustpan combination apparatuses the subject invention has now achieved.

Though only minimally relevant to the invention herein, there are several other patents disclosing individual dustpans that stably lie on the floor, being foot-maneuvered or foot positioned dustpans, that a user can place their foot upon, move or slide the dustpan as desired, and then, as well, firmly keep the dustpan still while sweeping debris thereonto, that have been devised.

As far back as Feb. 10, 1880, C. H. Heath discloses, in U.S. Pat. No. 224,334, a dustpan having a protruding "foot" that a user places their own foot upon during debris sweeping and collection. The protruding foot is disposed beneath, separate from a typical dustpan handle. Subsequent years of incremental improvement have yielded various modifications of this basic structure such as having additional "shrouding" to cover the foot, as in U.S. Pat. No. 226,877, Apr. 27, 1880, by M. F. Pierce, and further in another, disclosed in U.S. Pat. No. 422,240, Feb. 25, 1890, by C. H. Marshall, wherein the handle is substantially an open ring into which the user's foot may insert, maneuver and bear down upon during sweep-loading of the debris.

More recently, similar structures alike to the above, though now made with polymer molded materials instead of sheet or stamped metal, and representative of the much older said apparatuses and designs above, though modified, are found in U.S. Pat. No. 5,826,297, dated Oct. 27, 1998, by Harold Footer, et al, whereby also, similarly, a foot aperture, instead of metal fabrication, comprises a polymer/plastic molded hollow "foot-receiving" opening, alike in structure to and and achieving the said '240 patent above objectives.

It is to be also noted, by way of information only, that there have been several US Design patents issued in the last 15 years that embody polymer-molded cosmetic variations to one degree or another of the above discussed foot-moveable dustpan utility patents whereby a user may place their foot upon or within a handle portion or dustpan portion of the dustpan to effect the former patents' stated desired functionality, but, as well, the limited improvements in these foot-positioned/maneuvered dustpans also do not solve the enumerated problems discussed, either.

It is also to be noted that the present invention disclosed herein has a novel utility structure and function of even its dustpan (as resulting from its significant inventive steps achieved and its unique, independent dustpan structure as clearly distinct to that of the above foot-maneuverable dustpans discussed). The applicant's dustpan (itself, even able to be used apart from the modified inventive broom it functions with) is clearly structurally distinct from other dustpan structures (even as it pertains to the dustpan only, itself, without reference to being dependent for function on a typical broom or even the modified broom it combines with disclosed herein), in the present invention. Since, uniquely, as also being a foot-maneuvered, foot-depressed dustpan, the user places their foot upon the newly invented dustpan, having a devised upper middle gripping surface portion of the dustpan frame, itself (as opposed to placing their foot inside or upon the handle, or upon various protuberances or within foot sleeves, handles etc., in the former art), the applicant's dustpan, itself has many and significant advantages to the former discussed dustpan related patents themselves, irrespective of their relationship to any of the standard brooms they may be associated with.

More specifically, and hereby incorporating the following background paragraphs into the Summary below, in the present dustpan's innovation, the user's foot is placed upon a larger [relatively] novelly conceived surface area, essentially located in the more stable, middle body of the dustpan, thus providing a sturdier and more practical foot platform, better supported by the dustpan frame (rather than by, in the former art, only the handle, for example) with which, now the user may more effectively manipulate and position and stabilize the dustpan and maneuver during use in a more durable and robust minimalist frame, also ounce per ounce lighter, as compared to the former foot maneuvered dustpans.

While this unique feature is arguably a more effective structure than the above former dustpan structures (as pertains to their functional objectives) these advantages, specifically, are not the main focus of the applicant's application, since the even far more important and relevant objectives achieved by the unique Rapid Deploy, Foot-Activated-Detach/Auto-Attach, Magnetic Contact Combination Dustpan and Broom, and its unique function and structure, effective and safe results and useful, significant problem solving qualities and features are the primary focus herein, respectfully noted.

While these incremental improvements of former art above discussed have helped alleviate some of the stooping and squatting necessary and other potential stress or injury associated with hand-maneuvering of the dustpan—this, still, undesirably, occurs at the floor level—as, ultimately the user still must stoop down or bend over low and pick up the handle and pan after completing debris collection onto the pan.

Thus, four other, also tangentially relevant, only remotely related, and having far different structural attempts as pieces of former art, however are mentioned, as these patents go a degree further in alleviating the bending of the user, but respectfully stated, still fall significantly short in achieving the safer, more time and labor saving, comprehensive solution of the present invention, as will be discussed in the following Summary and Specification.

The first two patents actually "tether" the dustpan to the broom, first noting U.S. Pat. No. 1,082,128 Dec. 23, 1913, by S. P. Low, wherein a typical belt and buckle tether links both broom and dustpan. While clever, the utility and usefulness of the combo is diminished by the cumbersomeness, complexity and weight of the apparatus, as well as the limited distance a broom user can maneuver while sweeping around a tethered dustpan are a couple disadvantages.

The second, disclosed in U.S. Pat. No. 1,375,017, Apr. 19, 1921, by W. H. Russell, is an innovative combo wherein the dustpan is tethered by two "stretch cords" attached to opposite sides of the dustpan. The user steps on, or depresses with their foot, a "stirrup—#9" located upon the tethered dustpan while stretching the broom outward from the foot-stabilized metal dustpan. The limited length that the tether will stretch, the additional "pull" pressure required to additionally stretch the tether while sweeping, the fatigue the cord will eventually develop (thus not allowing the pan to snugly cleave back against the broom), are all disadvantages and limitations in an otherwise clever invention that, in marked contrast, the present invention overcomes.

Lastly, two more dustpan-broom combos whose dustpans can be lifted with the broom without significant bending of the user's body are found in WO 2019/089079 A1 (US Priority date: November 2017), by Eben Dobson, et al., disclose a broom that comprises mushroom head connectors that are depressed into receiving keyholes on the dustpan, thereby adhering it to itself after debris collection is complete. The disadvantages of this structure is the pressure needed to be exerted by a user to push down and engage these mushroom heads into the slots—and then, be required to pluck the dustpan off the mushroom head for emptying the dustpan contents, which is a significant inconvenience compared to the simplicity of function of the present invention.

The other patent EP 0,913,118 A, May 6, 1999, by Joseph Heinz Ohm, discloses a broom (shown as a standard push broom) that may engage a slot (#7) in the dustpan neck and handle area portion after debris collection is complete, thus allowing the user the lift the dustpan and contents for emptying without having to bend down and manually pick up the dustpan. The design is somewhat bulky and cumbersome and necessarily must cut out a large portion of the dustpan neck area to accommodate and support the relatively large push broom head, diminishing the effective of a potentially useful invention.

Thus the following objectives and advantages are discussed to address and solve the shortcomings in previous remotely related Art as contrasted with the objectives achieved by the unique Rapid Deploy, Foot-Activated-Detach/Auto-Attach, Combination Magnetic Contact Dustpan and Broom and its unique function and structure and Method/System of operation disclosed herein. Many objectives achieved have been included in the discussion above of the remotely related former art above and further objectives are hereby to be incorporated into the Summary, in the following, both added and discussed to that discussed above:

SUMMARY OF THE INVENTION

It is to be noted that in the above background much of the present invention's objectives and advantages and significant, many inventive steps have already been summarized above and therefore succinct, additional general Summary detail is provided to augment that of above, below.

Objectives of the Invention

It is therefore a primary object of the invention to provide a time and effort-saving combination broom and dustpan that both addresses and solves the significant serious shortcomings above by providing a novel broom and dustpan combination invention that nearly or even totally eliminates the need for a user to have to bend down to sweep debris into a dustpan, and thereby greatly minimizes back, shoulder and arm/hand injury risk, particularly for the elderly, when performing the task of sweeping a floor.

Additionally, an object desired is for a user not having to fully hold—grab or grip—the handle of the dustpan to empty it (unpleasant hygienically), but rather simply to "depress" or "tilt" the dustpan handle with one's hand or fingers—preferably, just one forefinger—only would be required to tilt and empty its contents, as both the dustpan and broom connected combo is easily lifted and emptied over the trash receptacle.

It is thus an object not to use tether or sleeved or snap-fitted connected apparatus but to use a far more durable and reliable use of magnets and magnetic materials, primarily ferrous based, that are strategically located upon preferable contact points 5, both upon the broom and the dustpan.

It is an object therefore to provide the dustpan/broom combination with at least one magnetically pivoting point that is also attachable-detachable, though the invention can still function well without this added convenience feature.

Moreover, it is a further object of the invention to provide a foot-maneuvered, form-fitted dustpan that can be easily "foot-depressed" off of or gently "kicked" or "knocked" off of the broom before a sweeping chore; conversely, the same dustpan can remain "onboard" the broom during the sweeping chore, thence afterward to be foot-depressed off for debris-loading.

It is another object to only require the user's alignment of the broom and dustpan magnetic contact points as the only thing necessary for the broom and dustpan (having been loaded with debris) to connect, before the debris-loaded dustpan is ready to be emptied. That is, the broom and dustpan would automatically "click" join together at that simple moment of said magnetic alignment.

Hence, the subject invention may be further summarized as follows:

A unique combination broom element and dustpan element that comprise a connected, uniquely functioning broom apparatus that comprises a typical standard broom (also, optionally a push broom in another embodiment) that preferably has a polymer bristle base upon which includes strategically placed mating/corresponding magnetic contact materials, (ie., magnetically matable contact material and mating points) such as a magnet material or a magnetic (or point) material on a magnetic receiving portion of the broom or dustpan, such as ferrous material, as an iron based strip, patch, disc, screw head, metal sleeve, for example.

The broom element magnetically (preferably snugly) supports the dustpan at these said corresponding or mating contact points, (ie., magnetically matable contact material and mating points) when the broom is in storage as well as, and, if the user chooses, while the broom is being used for sweeping chores.

The dustpan is preferably form-fitted to said polymer bristle base, aka., bristle carriage, and has a handle that form fits the broom handle, but as well has a protruding element to some extending degree that protrudes far enough from the broom handle surface such that a user may easily deploy the dustpan—ie., drop it to the floor by depressing the protruding portion of the handle with their foot, either after the sweeping process (the dustpan stays affixed while sweeping) or right before starting sweeping, the dustpan has been kicked off and is upon the floor during the sweeping process.

Not only does the present invention disclose the unique and highly useful novel utility structure and function of the new manner in which a dustpan and broom may now more easily operate and achieve the advantages and objectives above, its dustpan (as conceived, illustrated and described herein also from significant inventive steps achieved) and its unique, independent dustpan structure is clearly distinct and has advantages—alone as a dustpan—irrespective of the main invention disclosed, to that of the above dustpans discussed.

The applicant's dustpan as mentioned (itself, even apart from the modified inventive broom it functions with) is clearly structurally distinct from other dustpan structures (even as it pertains to the dustpan only, itself) and uniquely, as also being a foot-maneuvered, foot-depressed dustpan, the user places their foot upon the newly invented, devised upper middle gripping surface portion of the dustpan frame, itself, as opposed to placing their foot inside or upon the handle, or upon various protuberances or within foot sleeves, handles etc., in the former art), the applicant's dustpan, itself, has many and significant advantages over the former discussed dustpan related patents themselves, irrespective of their relationship to any of the brooms they may combine and function with.

Once the user has detached, preferably with their foot, the present dustpan's innovation, the user's foot is placed upon a larger [relatively] novelly conceived surface area, essentially located in the more stable, middle body or middle portion of the dustpan, thus providing a sturdier and more practical foot platform. This platform is further is located in the general mid-section of said dustpan.

This novel "foot-maneuvering" platform is preferably made of molded webbed square, round, or "honey-comb" et al open "cell" or lattice type shapes molded into the dustpan structure for high strength but lightweight and durable construction. Thus, is provided a better supported dustpan frame (rather than by, in the former art, a user stepping up only the handle, for example), with which, now the user may more effectively manipulate and position and stabilize the dustpan and foot-maneuver during use in a more durable and robust minimalist frame, which is another met objective in the present invention.

Further, the subject dustpan is automatically re-attachable (with debris inside) by simply placing the broom over the magnetic mating contact areas located nearly anywhere on the dustpan and broom. This novel objective, as do the other features of the invention discussed herein, as achieved, respectfully asserted, clearly required a series of sequential, inventive steps to achieve a highly satisfactory solution and result unforeseen by persons of ordinary skill in the art, involving critical inventive steps beyond and apart from what may be considered, former art, respectfully stated.

Another critical technological achievement and objective achieved that required several levels of inventive step is the magnetic (detachable/attachable) dustpan-to-broom hinge devised, that further enables the user not having to fully hold—grab or grip the handle of the dustpan—and carry the dustpan independently, and then bending down and lifting it to empty it.

What is plainly additionally novel in this disclosure (irrespective of the additionally inventive magnetic hinge disclosed), is the magnetic relationship of the dustpan and broom disclosed. Even if that required removing the said magnetically-attached dustpan from the handle by hand (or foot)—without the having an included magnetic hinge—the invention would still be a clearly inventive paradigm change in the old art (ie., unpleasant hygienically and functionally cumbersome, even potentially injurious, as discussed as having the grab the handle, as thoroughly discussed above).

Instead, however, the user simply "depresses" or "tilts" the dustpan handle with one's hand or fingers (as it remains "magnetically-hinged" to the broom) requiring only, nearly effortless labor, and an easily required action to empty its contents, as both the dustpan and broom connected combo is easily lifted over the trash receptacle and emptied—the tilted handle then simply needing a gentle finger, simply lever-activate, ie., push to return to its former snug position.

Lastly, one other key embodiment of the various modifications and applications possible for the invention is disclosed for push-brooms. The dustpan for this application, though being considerably larger, is quite similarly attached, however, preferably, similarly, attachably-detachably affixed to a push broom handle support frame area, in this case.

The push broom dustpan preferably, though not necessarily, has a form-fitted placement near or at the bristle support portion, ie., the said bristle carriage, or frame is physically unobtrusive, and the pan lip width can be much wider without being obstructive. The immense time and effort-saving operation of this typically (though used also by DIY and domestic users) industrial broom embodiment and application is significant, since industrial and commercial site debris loads are heavier, more urgent, and schedule constraints on clean up at construction sites are more time and cost sensitive than those more domestic and DIY tasks that most often use only standard upright broom and dustpan tasks. Moreover, employee associates "looking for a misplaced industrial dustpan" is a lost opportunity for otherwise productive worktime.

It is to be noted that the Summary above, Brief Description and Detailed Description the applicant describes many and varied inventive steps conceived and applied alternate sound structures and methods enabling one skilled in the art to carry out the invention.

All steps to achieve such are inventive in unique arrangement of componentry, sequentially structured elements, building upon one another and co-extensively integrated into the multiple-embodiment, single-specie invention, including parts that are not only interchangeable (with slight modifications) of the major components, but also with the many varied, optional and interchangeable, as will be described and illustrated as structurally germane to all of the invention embodiments disclosed and other possible modified embodiments.

For example, it is obvious that magnetic mating (ie., magnetically matable contact material and mating points) pieces can be positioned in a near limitless relationship on the brooms, dustpans and other respective parts than is nearly exhaustively, but not exhaustively shown in the drawings. As well, these parts may be reversed in their mating positions with various magnetic materials discussed.

Cosmetic or structural changes in the bristle support area, the bristles themselves, the magnet and FE strip/portion size, width or length, and shapes, as circular, square, triangular, for eg., or strength of the magnets and FE materials may assume myriad variations that foster desired push-pull off and re-attach forces that operate perfectly, adjusted to match the size, weight and function of the particular magnetic broom-dustpan combination.

As well, a narrow width, light weight, robust and compact, lean product and manufacturing "footprint" is clearly highly desirable. Minimalist, sustainable, low-cost manufacturing and weight-reducing elements, ribbing, comb structures, etc., are readily achievable by those presently skilled in the art as pertains myriad possible modifications that would remain within the spirit and scope of the applicant's invention.

Therefore, it should be obvious to one skilled in the present art to see many possible general modifications that may be substituted for those employed to achieve the purposes of the present invention, while not departing from the spirit or scope of the present invention. In addition, further characteristics of the invention may be understood by the following description and drawings, the preferred embodiments of which are by way of example and non-limiting to the spirit and scope of the invention.

BRIEF DESCRIPTION OF THE DRAWINGS

FIG. 2B is a front view of the broom of the magnetically coupled dustpan and broom invention as being magnetically joined with a broom user's foot activating (de-coupling) said dustpan.

FIG. 2C is a front view of the dustpan showing the de-coupling "drop" stage motion-shadow image of the magnetically coupled dustpan and broom invention.

DETAILED DESCRIPTION OF THE PREFERRED EMBODIMENTS

Figures 1, 1A, 1B, 1C:
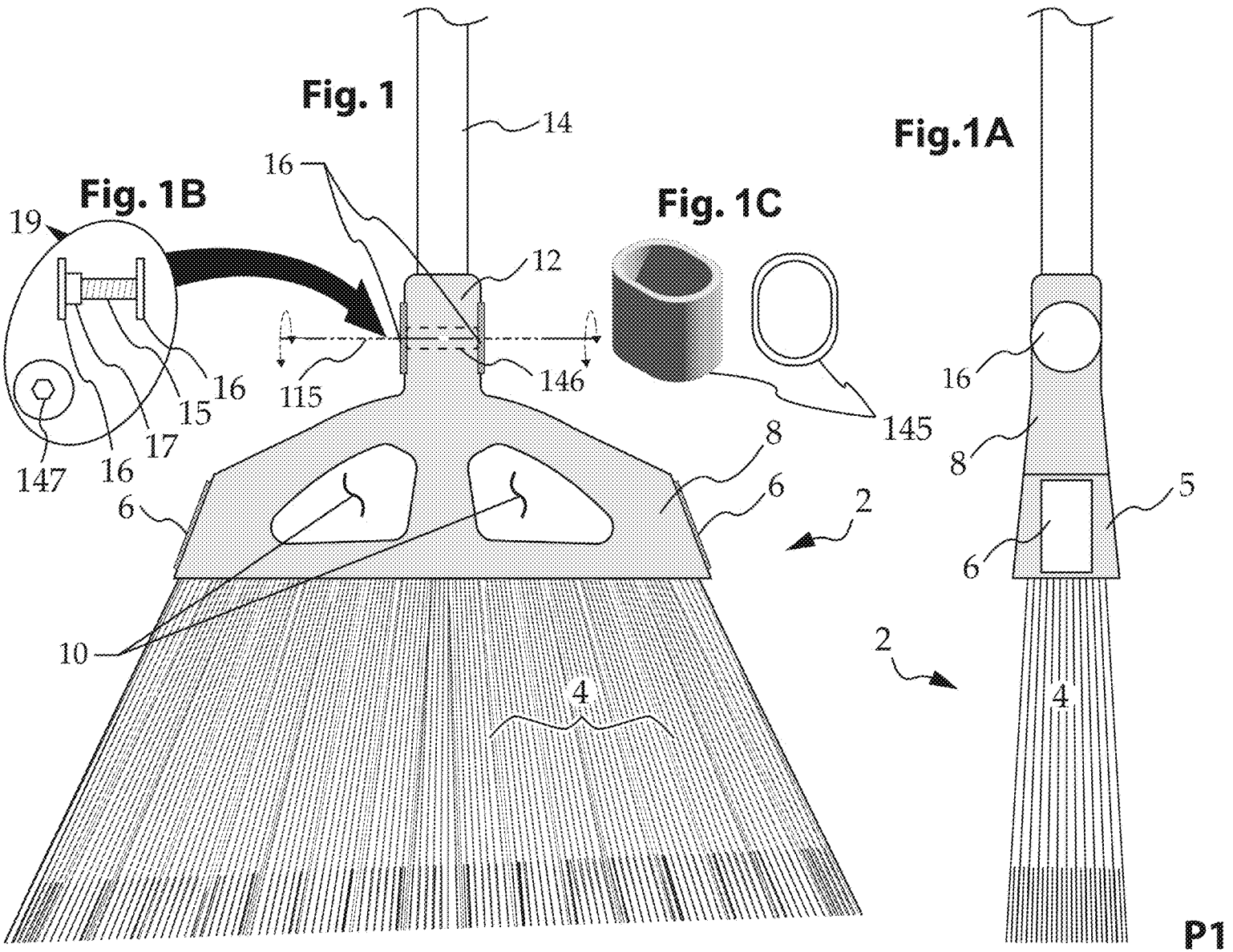
FIG. 1 is a front view of the broom of the magnetically coupled dustpan and broom invention.
FIG. 1B is a front magnified view of the magnetically attractive material, preferred flat ferrous disc-pin assembly located upon the broom of the said magnetically coupled dustpan and broom invention.
FIG. 1C is a front magnified view of the magnetically attractive material, preferred ferrous sleeve as a magnetic contact element.
FIG. 1A is a side view of the dustpan of the magnetically coupled dustpan and broom invention.

Now, noting all Figures: FIG. 1, FIG. 1B, FIG. 1A, FIG. 2, FIG. 2A, FIG. 2B, FIG. 2C, FIG. 2D, FIG. 2E, 2F, FIG. 3, FIG. 3A, FIG. 4, FIG. 5, FIG. 6, FIG. 7, and FIG. 8, but particularly, now FIG. 1, FIG. 1B and FIG. 1A where is illustrated what may be called a standard upright broom 2 having a handle 14 and a bristle carriage portion, aka., bristle base 8 that includes bristles 4 extending therefrom.

Said bristle portion 8 may be made of a polymer and have light weighting molded cavities 10, and a broom handle portion 14 connected thereto, but of most relevance is a magnetic material portion included thereon, aka., magnetic contact area 6, 16, respectively, aka., magnetic contacts areas 6, 16, aka, magnetic mating positions (aka, magnetically matable positions 6, 16 and 22, 24, that mate, respectively as shown, 6 with 22 and 16 with 24, for example with said ie., as said magnetically matable contact material and mating points), aka, magnetic "contact element" 6, 16 (which may comprise any number of various ferrous metal strip portions, aka, magnetically attractive portions, 6, 22 and 24, 16, for example, or all contacts may even be comprised of a hard or soft material magnet, itself—without the use of ferrous or other magnetically attractive materials—that are not in and of themselves "magnets" but shown, aka as a magnetic contact (ferrous metal) strip 6, that could be located anywhere on the said broom 2, preferably located upon (or within) the said bristle carriage portion 8, for example placed within or upon carriage side 5, aka., carriage edge 5, whereat could be one contact at least, but shown is a said ferrous metal strips 6, one on both sides of said bristle carriage 8.

Note: Only one single said magnetic or FE contact points 6, 22 (preferably located are one set of contacts on each side of said bristle carriage side 5 and one mating set located preferably inside the magnetic contact point 36 (as a flat area or slotted area, within dustpan 20) and 16, 24, for example, either at said mating magnetic contact points, respectively, (ie., magnetically matable contact material and mating points) in addition—though not necessary to the invention—forming a magnetic hinge 150 is optional to effectuate the subject invention, The present magnetic arrangement, having at least three and possible four said contact (Magnet or FE) mating points, 6, 22 and 16, 24 and are optional additional said magnetic contact points, in that the invention only require one strong magnetic contact mating point to operate, aka, magnetic contact points, but for refining the apparatus to function with maximum use, purpose, speed and reliability, as in the manner outlined in the Background, Summary and Specification Description, the said magnetic contact points, 6, 22 and 16, 24 are arranged and set in favorable positions and said magnetic hinge 150 arrangement to gain maximum function and advantages explained and illustrated herein.

Note: When describing said "magnetic contact points" 24, 16 and 6, 16, for eg., it is to be understood that the term refers either to an actual magnet as the contact point or a FE/ferrous [or other material that can be attractive to a magnet] substance that is attracted to a magnetic substance, as also a said "magnetic contact point" as well. These said magnetic contact points, 24, 16 and 6, 22, respectively, are also known as magnetic receiving portions 24, 16 and 6, 22, respectively, and can be a simple surface area located anywhere on the said broom 2, (as indicated by, in FIG. 5 an example of the near infinite possible mating positions, aka., mating locations 74), on said dustpan 20. Further, at least one magnetic contact point may comprise and be further defined as further a multiple magnetic contact point 74 that are further located upon the said combination attachable/detachable broom and dustpan 1 in any mutually matable locations.

As well, these said mating locations 74 do not need to be formed into slots to receive the said magnetic material, as magnetic contact points, which should be obvious. The said slots are preferred so as to guard these said magnetic materials/contact points to be nested and protected from being knocked off or bumped off of the broom or dustpan. As well, they are obviously easily seen to be interchangeable and are meant in language of the claims to be read and understood in that manner.

Further note wherein an optional additional (or used solely with no other said magnetic contact points 6, 16 necessary) contact area 16 on the support neck portion 12 of the said bristle carriage 8 comprises, preferably, at least one aka., magnetic contact area 16 aka., hinge magnet 16, aka., magnetic contact 16 (which, also may be comprised of any number of various ferrous metal strip or other shaped portions, or even comprise a hard or soft material magnet, itself), shown as a magnetic or optionally a ferrous metal disc said contact 16, aka., magnet disc 16, on at least one side of the said support neck 12. Note pivot axis 115, whereby the dustpan 20, as sown spatially, may pivot upon—while magnetically attached (a highly useful feature), though not an essential feature for the invention to function, described in more detail, following.

Figure 5:
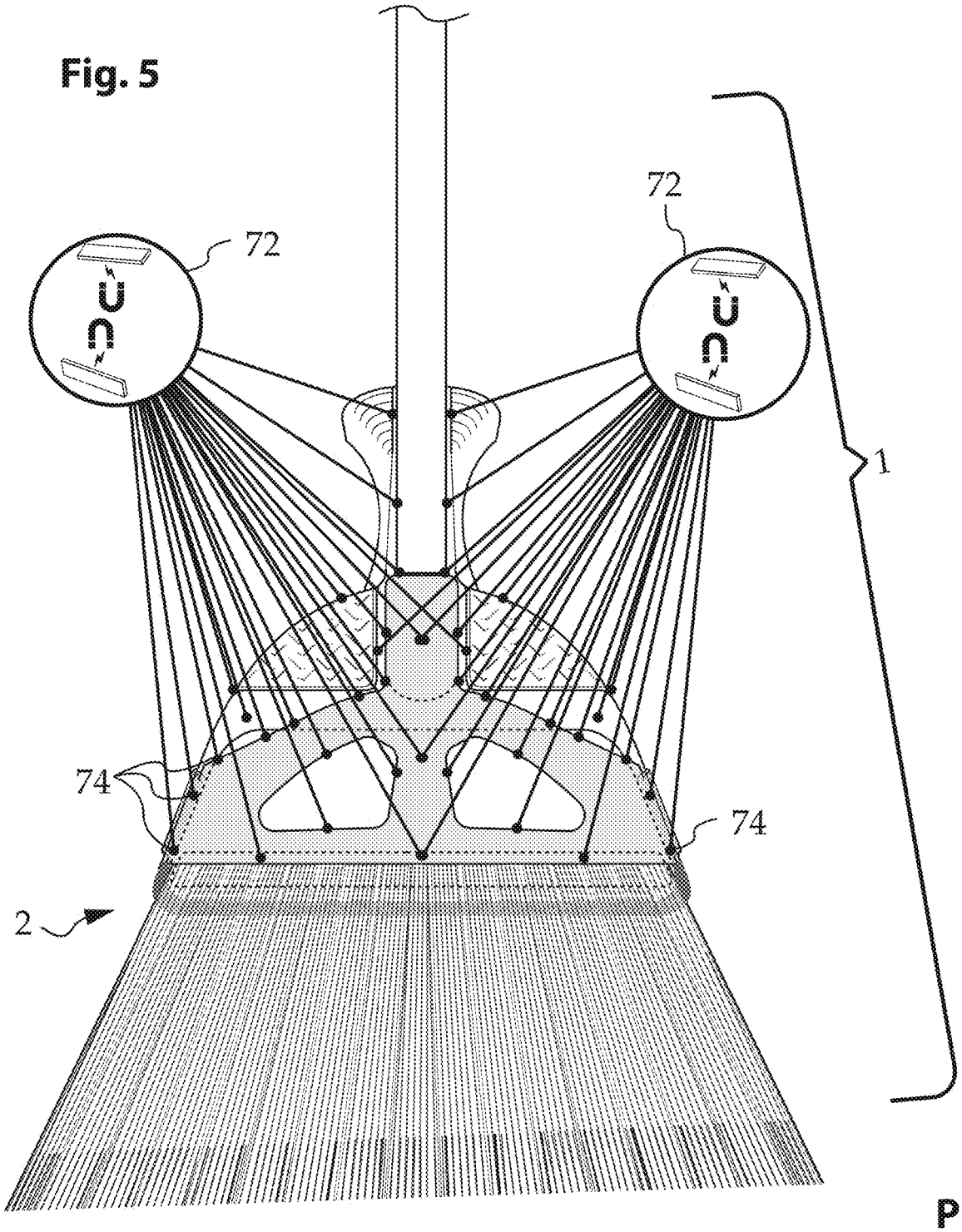
FIG. 5 is a front view of the magnetically coupled dustpan and broom invention illustrating the nearly infinite possible placement positions options of the magnetic mating (ie., magnetically matable contact material and mating points) elements upon or within the said the magnetically coupled dustpan and broom invention.
Figure 6:
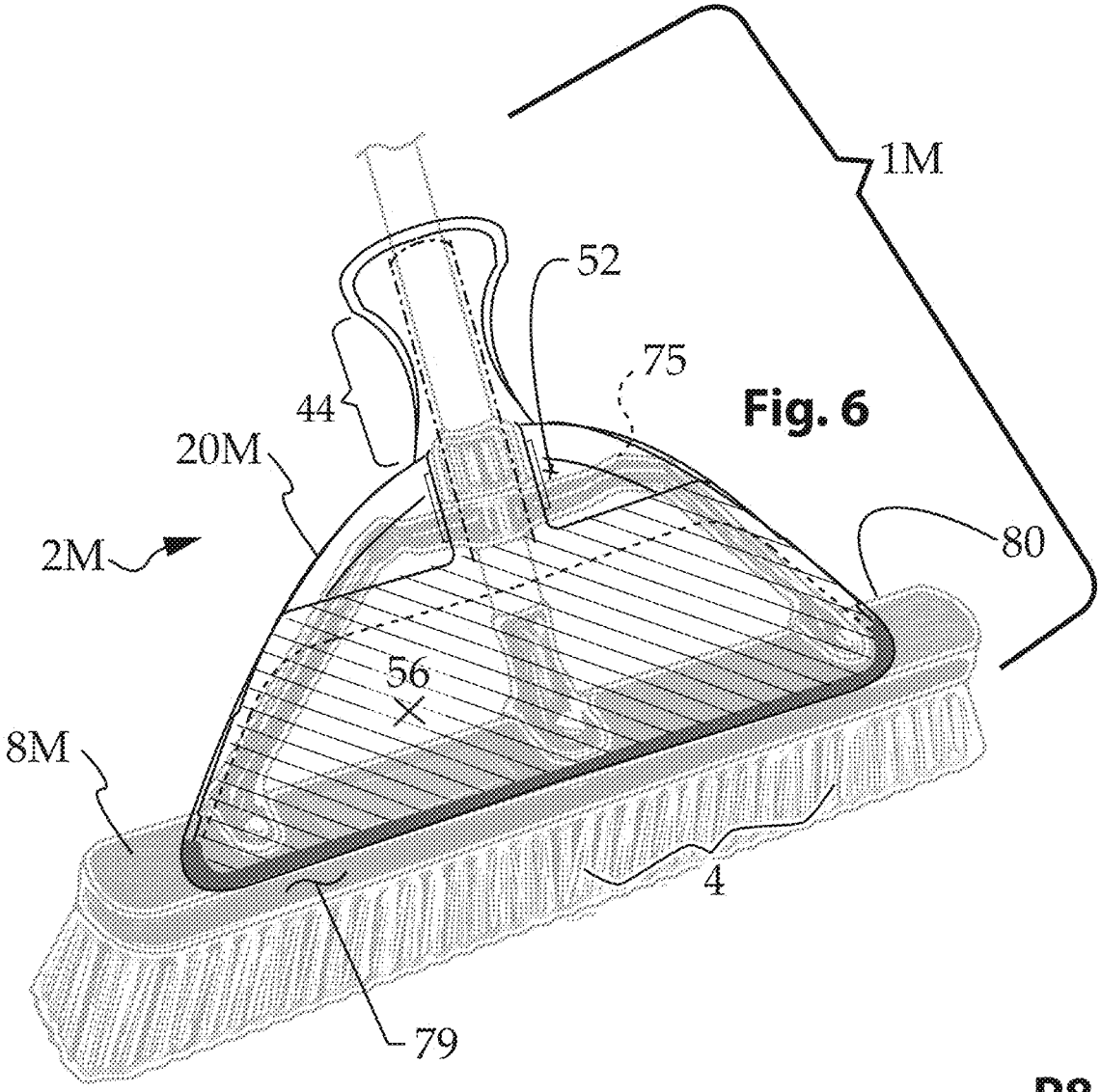
FIG. 6 is a front perspective view of the broom of the magnetically coupled dustpan and broom invention illustrating a modified, magnetically coupled broom and dustpan invention, the broom thereof being a push broom.

These said magnet (or optionally ferrous metal) said discs 16 may be stamped out of large sheet metal iron or thin steel rolls independently affixed to the said broom 2 or said dustpan 20 by powerful adhesives, glues, chemically bonded, friction or ultrasonically welded, et al, as well comprise a magnetic material assembly, be joined to the said neck 12—or affixed anywhere on the said dustpan 20, push broom dustpan 20M, respectively, as well as anywhere on the said broom 2 and push broom 2M, as shown in FIG. 5 and FIG. 6.

Note: It is clear that no FE material at all would be needed to make execute the invention in that "opposite-pole", ie., North to South pole match contacting points of solely magnetic material could be used in lieu of a "magnet to FE"

material. The FE material however would be lower cost and add less weight to the entire apparatus, easier to form into various sleeves, c-shaped curves, strips, coin-punched shapes, etc., and possibly quicker and easier to assemble/attach, being their greater advantages to use in manufacturing.

Moreover, as another of many alternate options to provide magnet material contact points, a front (magnified view) cap screw assembly 19 view made of preferably a ferrous material (though it could easily be a magnetic cap screw (or cap-pin 16—ie., not threaded, but instead, glued or press fit, for example, into said assembly 19 in FIG. 1.1, is a front magnified view of the magnetically attractive material, preferred flat ferrous disc-head pin 16 (also may be a said magnetic disc or magnetic material piece), aka, disc screw said assembly 19 depicting a flat head cap screw 15 having similar, now integral, said magnetic disc 16 head, joined to said with a female threaded portion 17, aka, cap nut 17 also having similar, now integral, said magnetic disc 16. The said cap screw 15 can be joined through a bore 146 in the said neck portion 12 and have an Allen head (as shown) or Torx, Phillips or straight Screw Driver head 147 for assembly purpose.

FIG. 1C illustrates another alternative to, among myriad methods and structures to carry out the invention, in that said cap crew assembly 19 can be replaced by a third, simple magnetic material wrapped or formed (as in a forging or extruded, or welded tube formed portion, etc., ferrous sleeve 145 that can be "crimped" FE strip, as well, attached in assembly as a very low cost, high speed manufacturing alternative, such as in an simple "press-fitting" automation operation.

The said magnet disc 16, aka., magnetic contact 16 magnetically mates or hingeably, magnetically attaches to a disc (preferably magnet and not a ferrous metal disc, however which would work equally as well as a ferrous metal disc) magnet disc 24, aka., magnetic hinge element 24, aka., a detachable-hinge magnet 24 that combines with the said magnetic disc ferrous disc 16 to form a rapidly detachable, then rapidly re-attachable magnetic hinge 150, aka., magnetic hinge assembly 150, aka., magnetic hinge 150 (aka, magnetic joint 150) that conveniently tilts on said spatial axis 115, aka., axis 115. magnet and wherein said at least one magnetic contact point 16 of said broom further forming a said magnetic joint 150 with said magnetic receiving portion 38 of said dustpan 20; said magnetic joint 150 further comprising, then, a said magnetic hinge 150. Note: said magnetic receiving portion of said dustpan 20 further comprises at least one magnet 24 and wherein said at least one magnetic contact point of said broom further comprises a magnet 16 (that, as said, can also be a Magnetically attractive material, as ferrous/FE), whereby both said magnets form a said magnetic joint 150.

The said magnet disc 24 (or aka, discs, aka, magnet 24)—affixed opposite one another inside receiving slots 38, aka, magnetic receiving portion 38, can also be simply flat surfaces that any of the magnets or magnetic materials discussed herein can be adhered to, as said throughout) preferably molded, though the said disc or discs 24 can easily be simply be glued to the substantially flat surface of the said dustpan 20 or said bristle base 8, (that is, glued upon a flat surface of the said dustpan 20 and thus not needing slots at all to fulfill the objectives of the invention) and thus be also termed a "magnetic receiving portion" 38 (again, that may not need to be constituted a slot to perform the desired hinge function).

Moreover, these said magnetic, FE materials are interchangeable with one being the magnet material and the other being magnetically attractive, for eg., FE material) and can be formed as wrapped around (see FIG. 1C sleeve 145 shape, for example) in any shape or form, as attached, affixed or connected to any—any—portion of the said handle 14, bristle base 8 said dustpan surfaces into said dustpan 20) can be a solid, for eg., neodymium or other rare earth, or alnico, etc. "coin" magnet shaped (or any other shape), but is preferably comprised of a flexible magnetic material, typically low cost, of relatively high gauss magnetism, soft magnetic material discs that may be punched/stamped out of magnetic flexible sheet material in manufacturing and assembled and snap-fitted or adhesive attached into said slots 38.

Figure 2A:
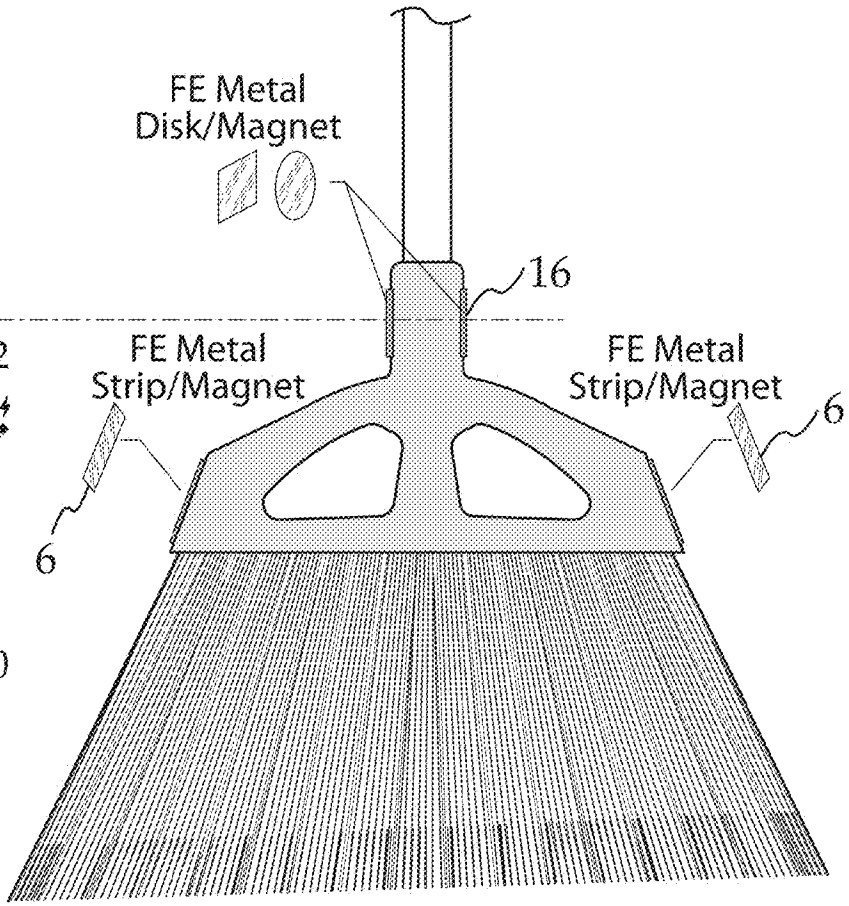
FIG. 2A is a front view of the broom of the magnetically coupled dustpan and broom invention, as in FIG. 1, however, also shown in alignment with magnetic tilt axis of said dustpan.
Figure 2:
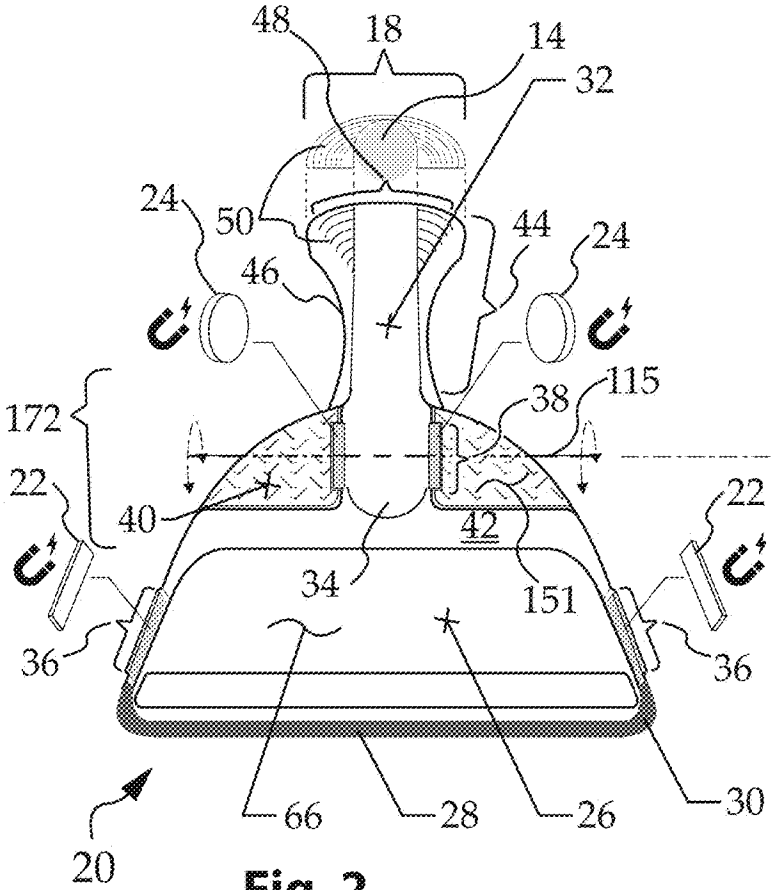
FIG. 2 is a detailed feature front view of the dustpan, similarly shown in that of FIG. 3, of the magnetically coupled dustpan and broom invention.
Figures 2D, 2E, 2F:
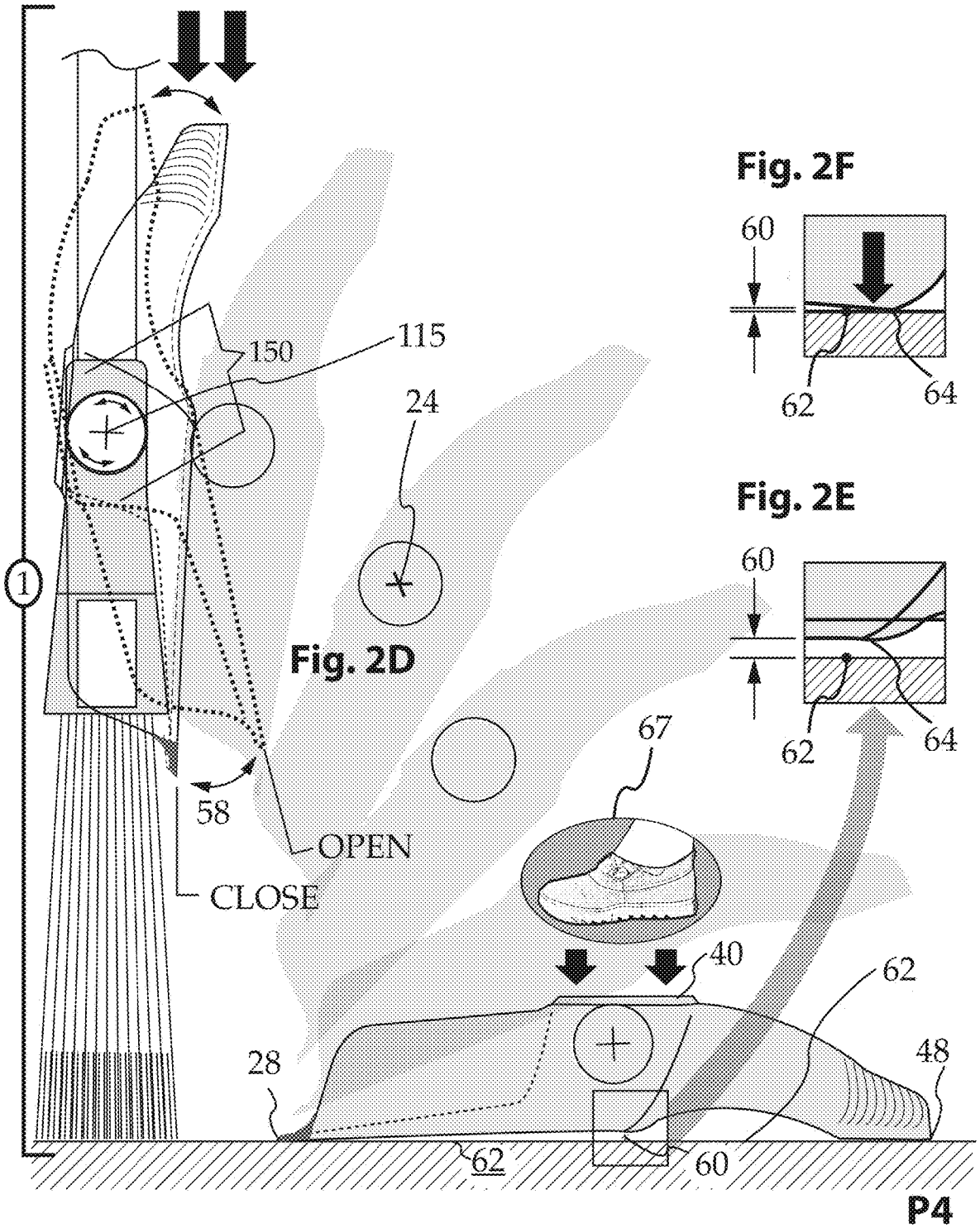
FIG. 2D is a side view of the dustpan showing the de-coupling "drop" stage motion-shadow image of the magnetically coupled dustpan and broom invention, also illustrating the magnetic tilt axis point (ie., magnetic hinge).
FIG. 2E is a front magnified view of the raised bottom (unsprung/undepressed) position of the aid dustpan broom of the magnetically coupled dustpan and broom invention.
FIG. 2F is a front magnified view of the lowered bottom (sprung/depressed) position of the said dustpan broom of the magnetically coupled dustpan and broom invention.
Figure 4:
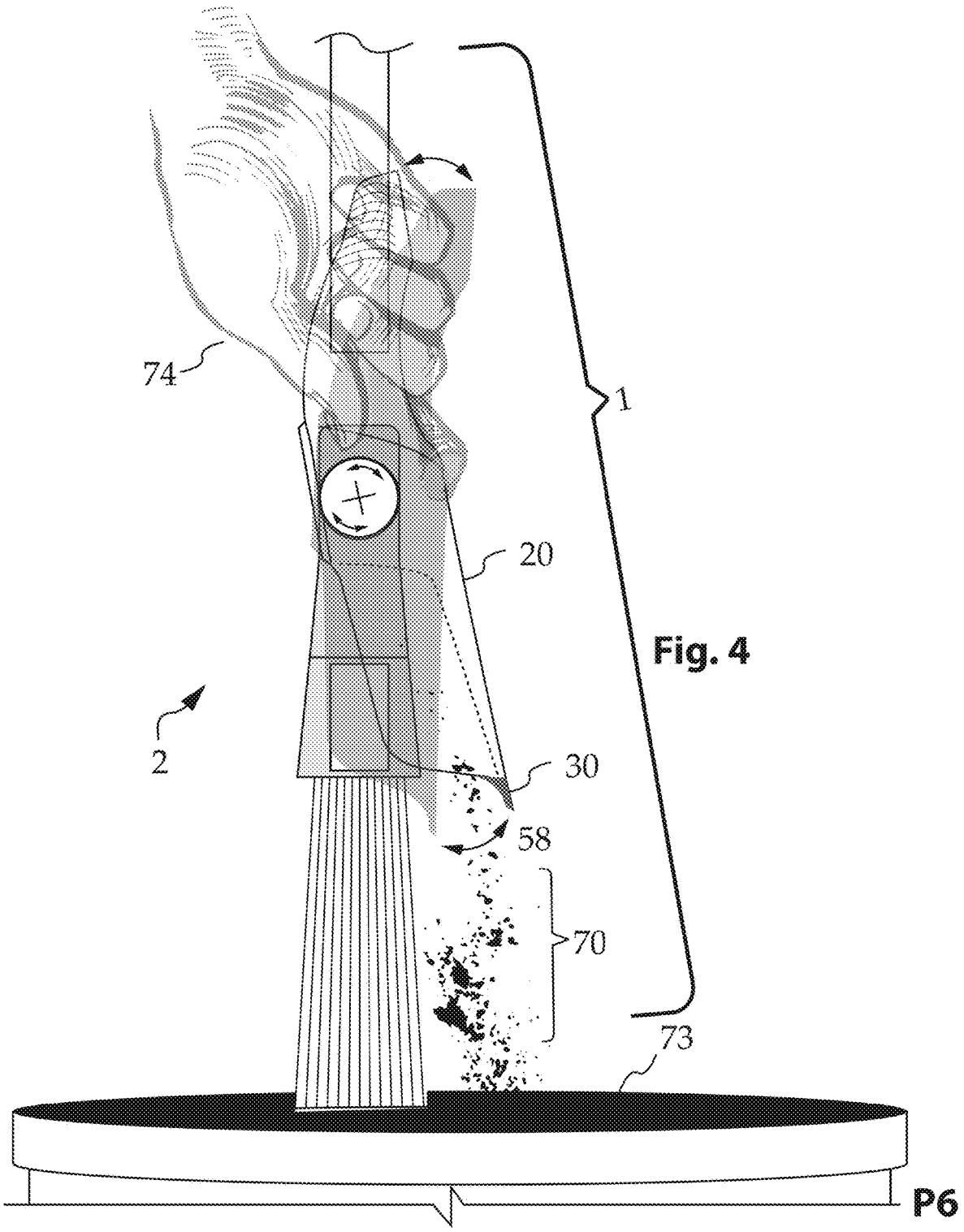
FIG. 4 is a side view of a user hand-activating the magnetic hinge of the magnetically coupled dustpan and broom invention, and emptying a debris-loaded dustpan into a refuse bin.

FIG. 2D and FIG. 4 clearly illustrates both the said hinge magnet 24 and said ferrous disc 16, aka., magnetic contact disc 16 working together as now comprising a said magnetic hinge 150 to effect aka, a tilting/hinging relationship 150 to enable debris management disposal (discarding the secured debris contents over a trash receptacle when finished, without ever having to separate the dustpan and broom). Note said relationship 150, as illustrated and described above, while being able to "separate" and detach, functioning as a said foot maneuverable dustpan 20 with said broom 2 into a single invention as is the said Magnetic Contact Dustpan and Broom 1. It is to be noted that placing one's foot onto or upon said dustpan 20 is preferred to be placing one's foot in the general mid-section 172, but as to a method, or step (as well as structure) to using said broom and dustpan invention 1 "placing foot onto dustpan" is equivalent to placing one's foot onto "any" part of the dustpan portion, as would be equivalent to anywhere the foot was placed upon or onto the former dustpans described in other prior art, foot-activated dustpans, particularly those discussed above and many other related in the art to these, which said dustpan's foot maneuvering dustpan areas, as handle, loops or rings, sleeves, protuberances, et al, or portions, are now incorporated into and usable and easily adapted within the present invention's dustpan.

Note: It is not necessary for the invention to have the said magnet disc 24 be disc shaped, of course, or to have the magnet disc 24 be hinge-capable or "hingeable"—as that Disc could, less preferred, have a flatly affixed magnetic contact, yielding simply a flat (as opposed the present "rolling" and "sliding" contact preferred), contact and thus require a hard-pull that a user would need ot exert to "pluck" off the dustpan, requiring much larger force than that of the said magnetic hinge 150, of course. The flat contact would require a user "pulling" and prying the dustpan off with their hands rather than the convenient slide off and "rolling motion" as structurally provided with the said disc magnet 24 and said magnetic hinge 150. Moreover, many, many versions and modifications can be easily conceived and made by a person of ordinary skill in the art (now that the applicant has thoroughly taught through a series of novel inventive steps and invented technology), such as using "barrel-type" magnets, or even spherical, semi-spherical, oval, et al., that could function to provide a hinge effect, beyond what could be an "easily-provided" flat magnetic contact as discussed (requiring pull-force and thus undesirable) contact point, instead.

It should be obvious now that the applicant has taught a magnetic broom and dustpan apparatus for a person skilled in the art to make obvious changes and modifications in the hinge area (even without using the advantages of a detachable said magnetic hinge at all) and other position and "form" structural changes such as offsetting the magnets or magnetic ferrous materials and shapes, as well as making the slots and connecting magnetic material of myriad modifiable relationships, sizes and shapes and attachment placement and arrangement for carrying out the subject invention.

In FIG. 2 further note dustpan 20 handle portion 44 (with scallop area 46, aka, scallop portion 46—which portion acts as and aka., as a finger/hand tilting-trigger debris release) wherein is preferably molded a broom handle cavity 32 (aka., pivot cradle 32) and a push portion 48 (having optional gripping surfaces 50 molded thereon, as also shown as molded semi-annular grooves in top view portion 18), which may also be defined as a protruding element/portion 48, aka., a foot-depressible portion 48, aka, a kick-activation portion 48, extending to a degree that protrudes far away enough from the said broom handle 14 such that a user may easily deploy the said dustpan 20—ie., drop it, foot-depress it, ie., kick-drop said dustpan 20 to the floor, 62, aka., sweeping surface 62, by depressing the said protruding portion 48 of the handle with their foot 67 (or even hand if desired), as further illustrated in FIG. 2B, wherein the actual combined elements are now shown to be the complete, assembled invention of Rapid Deploy, Foot-Activated-Detach/Auto-Attach combination Magnetic Contact Dustpan and Broom 1, aka., Magnetic Contact Dustpan and Broom 1, aka., MCDB 1, is shown in simple functional use, as the combination of said dustpan 20 and said broom 2. Note also Figure C where said dustpan shadow shows movement and rotational arrows illustrating directional force down and the drop arc arrows showing dustpan-detaching "arc-drop motion" movement of said dustpan 20, activated by said foot 67.

It is to be observed optional, additional magnet material strips 22 that fit into slots 36, ie., aka, magnetic receiving portion 36 (Note: these said slots 36 can also be simply flat surfaces and function just as well), preferably on the side of the said dustpan 20 mate with the said ferrous (FE/iron content—or other magnetically attractive materials) metal strips 6 (though these are not necessary for the invention to function well) and that these magnets 22 also disengage as the user when in foot detach (press down) mode drops said dustpan 20. It is to be noted that these said magnets 22 (which, of course may be FE material, instead, mating with magnets) themselves may not be needed, but only the said hinge magnet 150 only or even a non-hinge, single (flat contact) magnet could be sufficient to execute the invention, placed nearly anywhere on the said broom 2 and said dustpan 20 in mutually matable contact arrangement.

However, when a larger amount or weightier amount of debris is swept onto the said pan 20 and lift by the user the said magnetic hinge 150, aka., magnetic hinge assembly 150 may not provide enough gauss or magnetic strength for sustained holding of the pan (Note: whether hinged or solid-fixed holding magnetically), and thus the additional said magnetic contact point 22 or points would be useful for stability as the said broom 2 and said dustpan 20 are magnetically joined or "re-coupled" as the user suspends the said pan and lowers said broom over separated said dustpan 20, while matching all (or at least some of) the magnetic "mating" contact points, the user then senses—feels—the magnetic contact points 6, 16, "click" together. Immediately afterward then lifts the said Magnetic Contact Dustpan and Broom 1 as a single unit, tilting said handle 44 with preferably one finger and emptying it in trash bin 73, as in FIG. 4. It is to be noted that it is preferred that the said broom and said dustpan 20 be substantially symmetrical such that either side of the said broom could magnetically attach and fully mate with the said magnetic contact points, 6, 22, 16, 24, respectively, though this structural feature is not necessary, it adds convenience of use.

It is easily seen that only one said magnetic hinge 150 need be formed with the said magnetic contact points, 6, 22, 16, 24, respectively, being clearly shown in FIGS. 1, FIG. 2 and FIG. 2B, preferably comprising the convenient said magnetic contact points (which again may either be magnets or magnetically attractive materials as FE, as said) of said magnetic contact point (magnet) 24 and said FE material 16 however.

Note further that said dustpan 20 has a typical inner pan inside area 66 the outer edge of which has an optional soft polymer rim 28, aka., rubber lip 28, which itself has reinforced rounded rubber corners 30 that protect the said pan 20 from breaking a corner, as, necessarily, it would be dropped to the floor at least once during each sweeping task, in use.

Above the pan front (aka., top) inside bottom surface 26 and inside said spatial area 66 that backs up to a stop wall 42 is whereinto said carriage 8 may snugly fit in storage and during sweeping, if wished, though typically the said dustpan 20 would be detached by the said foot 67 before beginning sweeping.

Once the said dustpan 20 is dropped, ie., detached, then user places their said foot 67 upon a upon a larger, generally flat surface area, essentially a foot-maneuvering platform 40, aka., foot pad 40 aka., foot support portion 40, aka., platform 40 located in the more stable, middle body portion 172, aka, flexing mid-portion 172, of the said dustpan 20, thus providing a sturdy said foot platform 40 (located in the general mid-section of said dustpan), that enables rapid positioning on a floor by a user's said foot 67 without the need for use of a user's hands 155 manipulating the said dustpan 20, said handle 44 also while necessarily bent over, doing so.

Figure 3:
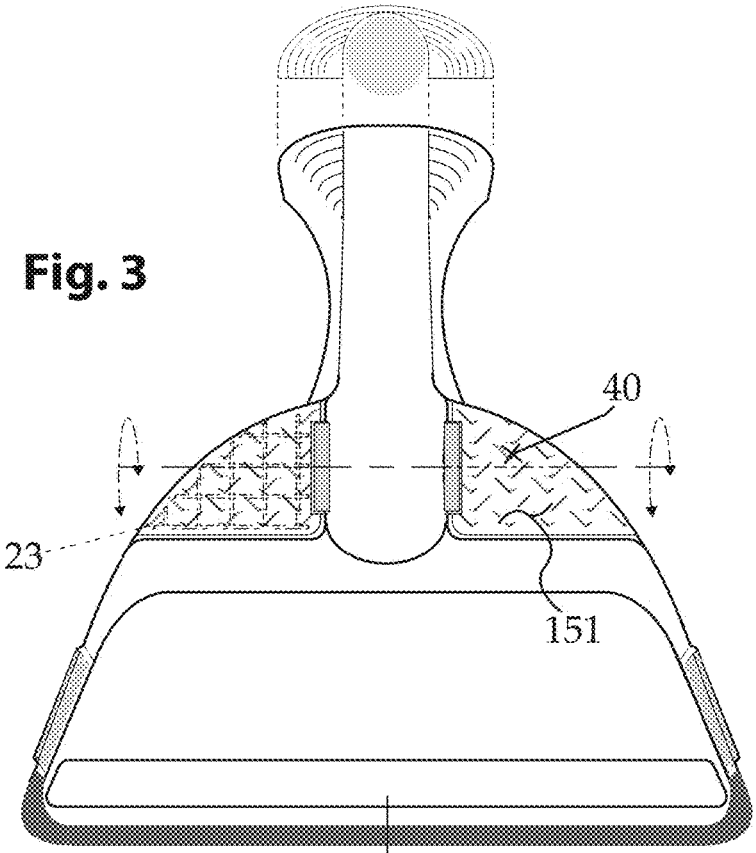
FIG. 3 is a front view of the dustpan, similarly shown in that of FIG. 2, but shown with minimal numbering for added clarity, of the magnetically coupled dustpan and broom invention.
Figure 3A:
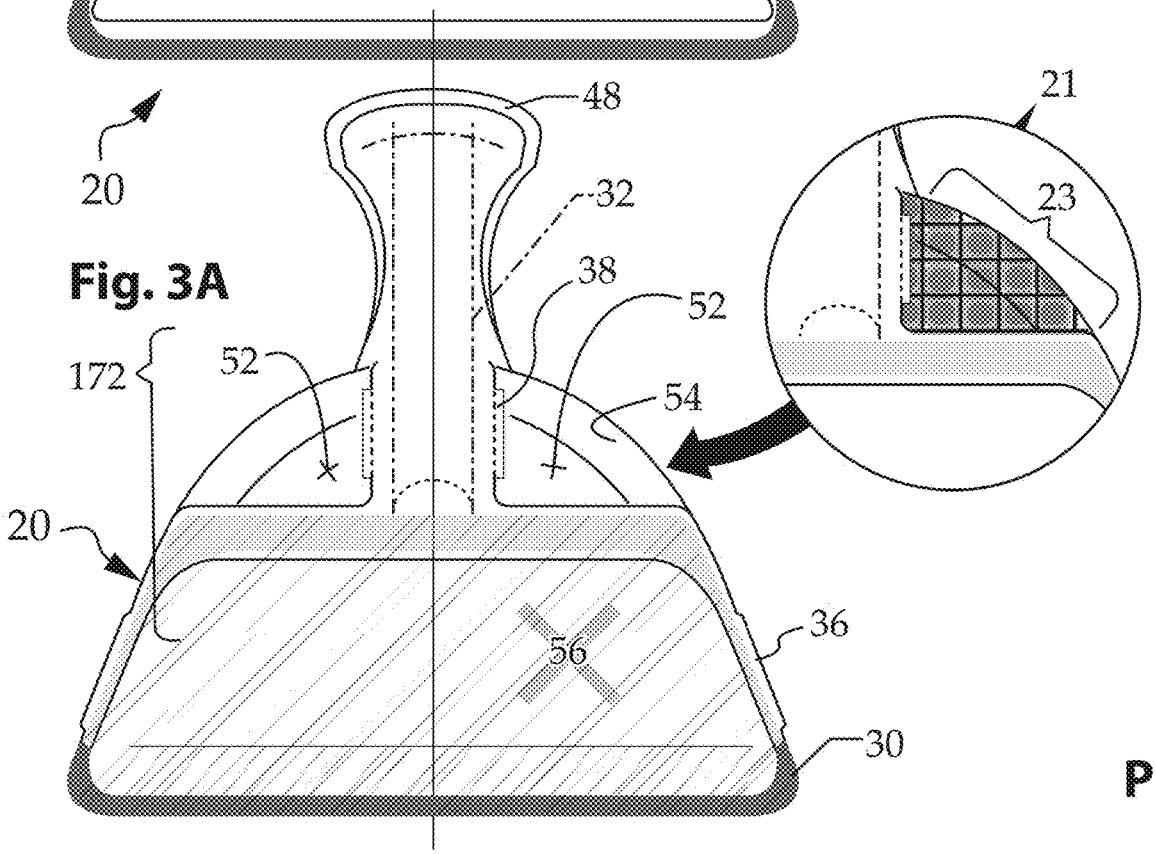
FIG. 3A is a back view illustrating the optional, preferably molded lattice structure of the dustpan of the magnetically coupled dustpan and broom invention.

In FIG. 3 and FIG. 3A, additionally, notice upper said middle body 172 gripping surface portion 151 on said platform 40 of the dustpan 20, itself, (as opposed—in former art discussed—to placing their foot inside or upon the handle, or upon various protuberances or within foot sleeves, handles etc., in the former art), where underneath, ie., backside cavity 52 (shown as void that has support wall 52) that may comprise, as shown in magnified view 21, optionally molded-in support ribbing 23, aka, molded support cells underneath 23, aka., honeycombing support 23 that can be added into said void 52 made in shapes of square, hex, round, triangular, oval, and other honeycomb-like shapes devised for added strength and support for supporting a user's said foot 67, even full body weight, if needed.

In FIGS. 2D and 2E further note a magnification box in which flex space gap 60 is open, illustrating an "unsprung" position (located underneath and comprising a sightly bowed said foot platform 40 unspring space gap 60 on its bottom side in a flexing mid-portion 172.—ie., before the user depresses the said foot pad 40 and dustpan touch point 64 is still suspended and non-gripping to floor point 62. Then in Figure, user depresses said pad 40 and said foot activation point 48 grips the said floor 62, and thus process fixes firmly the said dustpan 20 for sweeping debris thereonto, noting the "sprung" position in FIG. 2F the magnification box illustrating the said touch point 64 is now touching and gripping the said floor 62 and space gap 60 is closed.

Noting again, FIG. 2 and FIG. 2A, the said magnetic pivot point 115 said magnetic contacts 16 respectively, work with the said magnet 24 to constitute said magnetic hinge 150, enabling said tilting or oscillation, (for opening up for debris emptying) by a user's hand 155 when emptying the debris contents 70 into said trash bin 73, the arc swing of open motion of the dustpan represented by motion limit arc arrow 58, ie., arc arrow 58 (and at the same time allows for detachable- and re-attachable convenient "reset" of the hinged relationship of the broom and pan when separated and allowed to magnetically rejoin, as discussed above). Note: The said magnetic receiving portion 38 of said dustpan 20 further comprises at least one said magnet 24, eg., and wherein said at least one said magnetic contact point 6, 22, 24, 16 of said broom further forming a magnetic joint with said magnetic receiving portion of said dustpan; said mechanical joint further comprising a said magnetic hinge 150.

Noting now FIG. 5 an example of the near infinite possible said mating positions 74, aka., mating locations 74, of said magnet materials, 6, 16, 24, 22, in any order, respectively, can be positioned on or in the said broom 2 and said dustpan 20, as represented by magnification views 72.

Next, noting FIG. 6, another category modified push broom dustpan 20M and push broom 2M combination 1M, though being typically larger than said dustpan and broom combination 1, has its said dustpan 20M quite similarly attached, however, preferably, magnetically attached-detachably affixed to a bristle support 8M (having front face 79 and back face 80) and said bristles 4, and further having handle support frame area 75, aka, brush frame 75, aka, support frame 75, having said push broom dustpan magnetically attached to a modified, said bristle support 8M in this alternative said combination broom and dustpan 1 structure. It is to be noted that the said frame 75 could simply be magnetically attractive and serve fully as its own said "contact point" 24, 16, and 22, 6, being made out of a said ferrous material, whereby said magnets 24, 22 can simply attach to as described and illustrated in FIG. 6 and FIG. 7.

Figure 7:
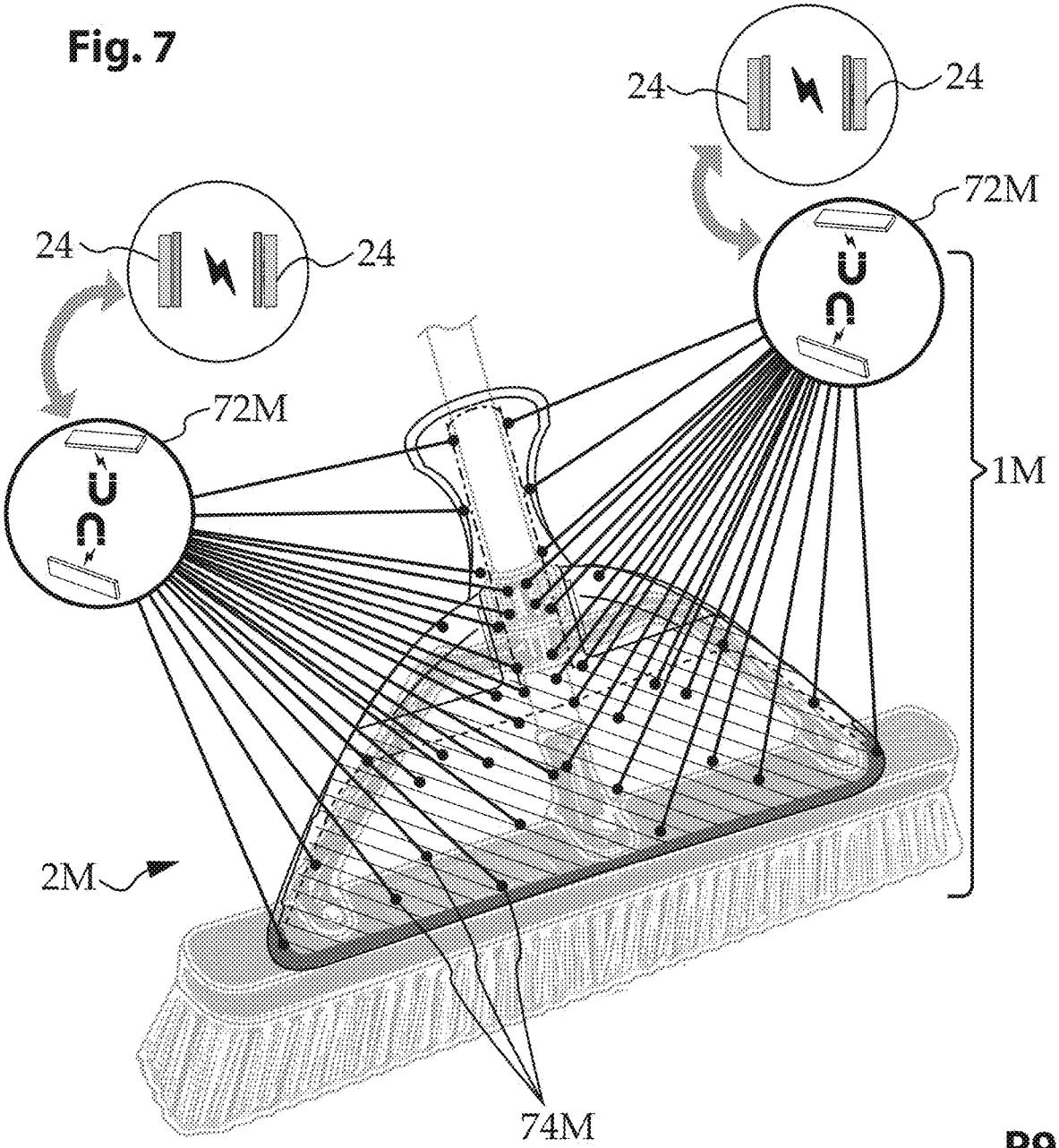
FIG. 7 is a front perspective view of the magnetically coupled dustpan and broom invention of FIG. 6 illustrating the nearly infinite possible placement positions options of the magnetic mating elements upon or within the said the magnetically coupled dustpan and broom invention.

Similarly to FIG. 5, noting now FIG. 7, note likewise an example of the near infinite possible mating positions 74M, aka., mating locations 74M of said magnet materials, 6, 16, 24, 22, in any order, respectively, can be positioned on or in the said push broom 2M and said dustpan 20M, as represented by magnification views 74M.

Figure 8:
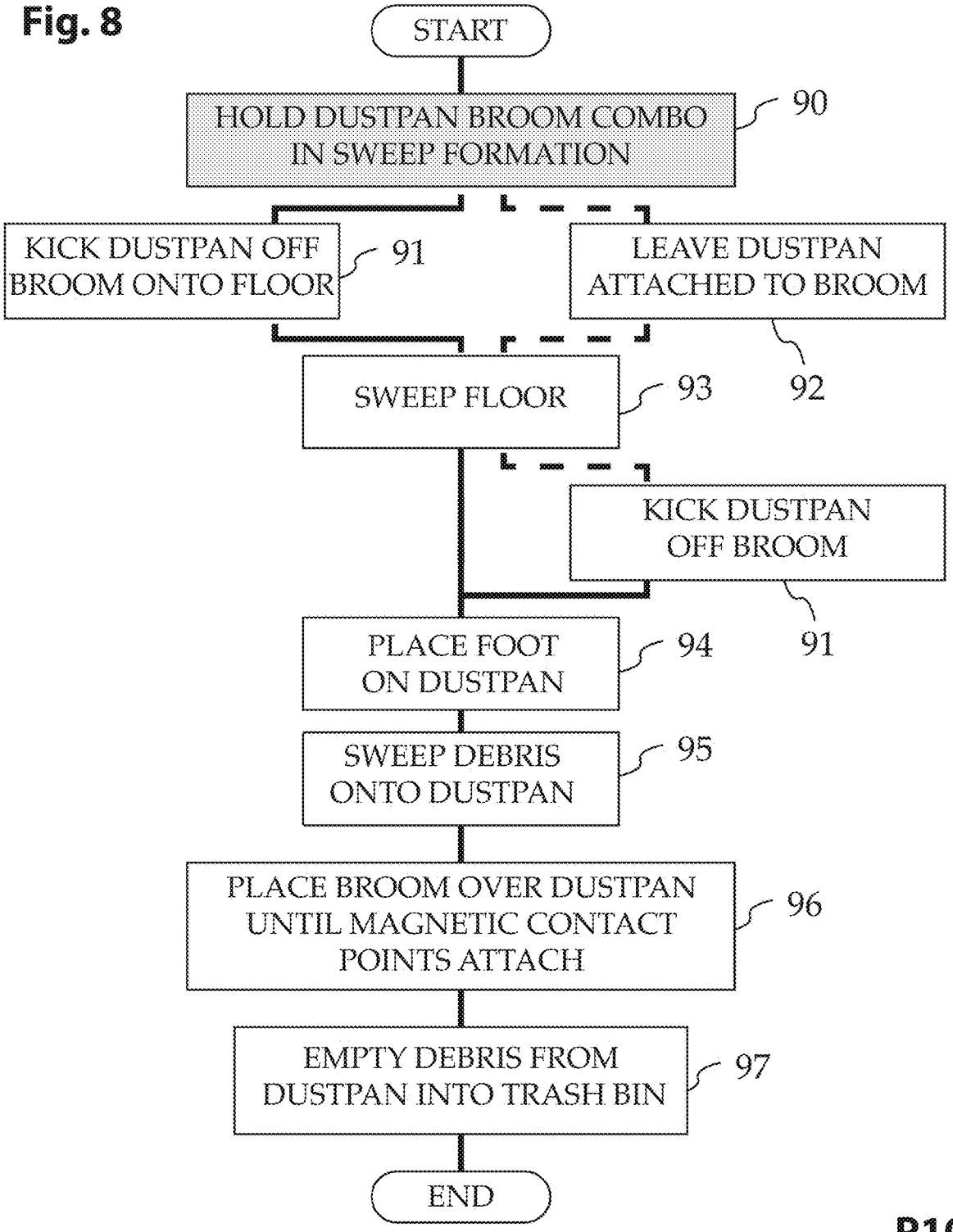
FIG. 8 is a process chart, aka., as a method steps, aka, a system of using the broom of the magnetically coupled dustpan and broom invention.

Lastly, in FIG. 8, as well as through the clearly delineated steps, methods, process, system of operating the said invention as thoroughly discussed above, a flow chart of method of use or process of operation is disclosed. Note box 90, which is added only by way of assumed reference only to obviously hold said broom 2 and dustpan combination 1 in sweep formation box 90, whereby then box 91 describes the first actual step of kicking (removing by foot or hand) said dustpan 20 off onto the floor, then user sweeps floor, box 93.

User next places foot onto said dustpan 20, described in box 94 and then sweeps debris onto said dustpan 20, shown in box 95. The next step, or process sequence in box 96 requires the user to place said broom 2 over the said dustpan 20 until said magnetic contact points 6, 22 and 16, 24, respectively attach or make contact. And finally, the said debris 70 is dropped into said trash bin 73.

The apparatus and process may be termed more technically, then as the combination attachable/detachable broom and dustpan 1 wherein said broom 2 further having a said broom handle 14 affixed to a said bristle support 8 whereat said broom bristles 4 are affixed to said bristle support 8 and wherein said dustpan 20 further having said handle 44 and further having a said foot activation portion 48, which it is to be noted may alternately be comprised of any number of various "protuberances" or areas that even do "not project" from the said dustpan 20 but that are that are activatable by the said foot 67 of a user. Said dustpan 20 further comprising at least one magnetic contact point, for example, said 6, 22, and said 16, 24 or any single or multiple combination of possible contacts points thereon discussed; said broom 20 further comprises at least one magnetic contact point, eg., 6 thereon.

Said dustpan's 20 said at least one magnetic contact point, eg., 6, further being in a magnetically matable position, eg., 6, 22 and/or 16, 24, as discussed to said broom's 2 said at least one magnetic contact point, as thoroughly discussed.

As well, the said dustpan 20 is both kick-drop detachable, by a kick-activation portion 48 (or hand detachable, if preferred)—see discussion of FIG. 2B and FIG. 2D) and magnetically re-attachable in operation without a broom user having to use their hand on the dustpan to effectuate said magnetically matable positions, re: said 6, 22 and/or 16, 24) (suggested positions but by no means exhaustively depicted sample magnetic contact points magnetic, as thoroughly discussed.

Alternate modifications to the structure, system, method or process, once the applicant has thoroughly taught the system and structure in the above application, should be obvious to one skilled in the art as a logical alternative and useful in many cases or sweeping tasks to leave said dustpan 20 on the said broom 2 during the process of sweeping, described in step box 92, kicking or removing said dustpan 20 off of said broom 2 after the said step box 93 of sweeping floor.

Other variations and modifications of the present invention will be apparent to those of ordinary skill in the art, and it is the intent of the appended claims that such variations and modifications be covered. The particular components, configurations and assemblies discussed above can be varied, and are cited to illustrate representative embodiments of the present invention and are not intended to limit the scope of the invention. Other equivalent elements, methods and steps can be substituted for those described and illustrated herein; parts, steps and elements may be reversed, expanded, modified and certain features of the invention maybe used independently of the use of other features, all without departing for the spirit and scope of the invention, as defined in the subjoining claims.

The intent of the following Claims are to be interpreted and construed such that the Independent Claims would be broad enough to cover any broom and dustpan combination that can be magnetically joined or coupled, besides those described and illustrated throughout the embodiments disclosed herein and any logical derivatives thereof, such that the independent claims would cover a wide scope beyond any of the basic embodiments or versions, as clearly and exhaustively proven to be of one single, unified, invention species, respectfully.

The invention claimed is:

1. A combination attachable/detachable broom and dustpan comprising:

a broom having a broom handle affixed to a bristle carriage portion whereat broom bristles are affixed;

a dustpan having a pan, a handle, and a foot activation portion; said dustpan further comprising at least two magnetic contact points thereon; and wherein said broom further comprises at least two magnetic contact points thereon; said at least two magnetic contact points of said dustpan being fixed in a magnetically matable position to said broom's at least two magnetic contact points thereby forming at least two magnetic contact pairs; and wherein said dustpan is configured to be both kick-drop detachable and magnetically re-attachable in operation without a broom user having to place their hand on the dustpan to effectuate said magnetically matable positions;

wherein one of said at least two magnetic contact points of said broom being located upon said bristle carriage portion proximate said handle forms a magnetic hinge with the corresponding one of said at least two magnetic contact points of said dustpan located on said dustpan handle, and wherein one of said at least two magnetic contact points of said broom being located upon said bristle carriage portion proximate the bristles forms a magnetic securing portion with the corresponding one of said at least two magnetic contact points of said dustpan located on said dustpan pan;

wherein said magnetic securing portion secures said dustpan pan against said bristle carriage portion when both magnetic contact points of said dustpan and said broom are attached together;

wherein said magnetic hinge allows said magnetic contact points of said magnetic securing portion to detach from one another such that said dustpan pan pivots away from the bristle carriage while said magnetic contact points of said magnetic hinge remain attached to one another such that debris held in the dustbin can be emptied into a trash bin.

2. The combination attachable/detachable broom and dustpan as recited in claim #1 wherein wherein said at least two magnetic contact points of said dustpan further comprises magnetic receiving portions having magnets affixed thereto.

3. The combination attachable/detachable broom and dustpan as recited in claim #2 wherein said magnetic receiving portions of said dustpan further comprises molded slots which receive said magnets of the magnetic receiving portions.

4. The combination attachable/detachable broom and dustpan as recited in claim #2 wherein said magnetic receiving portion of said dustpan further comprises at least one magnet and wherein said at least two magnetic contact points of said broom further comprises a magnet.

5. The combination attachable/detachable broom and dustpan as recited in claim #2 wherein said at least two magnetic receiving portions of said dustpan further comprises at least two magnets and wherein said at least two magnetic contact points of said broom further comprises a ferrous material.

6. The combination attachable/detachable broom and dustpan as recited in claim #1 wherein said at least two magnetic contact points of said broom thereon comprises a ferrous sleeve magnetically mating with the said at least two magnetic contact points of said dustpan.

7. The combination attachable/detachable broom and dustpan as recited in claim #1 wherein said at least two magnetic contact points of said broom further comprises a ferrous cap-screw magnetically mating with said at least two magnetic contact points of said dustpan.

8. The combination attachable/detachable broom and dustpan as recited in claim #1 wherein said at least two magnetic contact points of said broom further comprises a ferrous cap-pin magnetically mating with said at least two magnetic contact points of said dustpan.

9. The combination attachable/detachable broom and dustpan as recited in claim #5 wherein said dustpan handle whereupon is located the said kick-activation portion and wherein said handle further comprises a scallop portion.

10. The combination attachable/detachable broom and dustpan as recited in claim #9 wherein said dustpan further comprises a foot platform located in a mid-section of said dustpan.

11. The combination attachable/detachable broom and dustpan as recited in claim #9 wherein said kick-activation portion extends away from said broom handle.

12. The combination attachable/detachable broom and dustpan as recited in claim #10 wherein said dustpan further comprises an outer edge upon which is affixed a rubber lip; and wherein said dustpan when placed on a flat surface has an unsprung gap between said flat surface and a bottom of said dustpan underneath said foot platform.

13. The combination attachable/detachable broom and dustpan as recited in claim #12 wherein said foot platform further comprises molded support cells underneath.

14. The combination attachable/detachable broom and dustpan as recited in claim #1 wherein said broom is further defined as a push broom and wherein said bristle carriage of said push broom further comprises a support frame which magnetically supports said dustpan.

15. The combination attachable/detachable broom and dustpan as recited in claim #14 wherein the said support frame of said push broom further being made out of a ferrous material, whereat said dustpan magnetic contact points may mate.

* * * * *